US009354612B1

(12) United States Patent
King et al.

(10) Patent No.: US 9,354,612 B1
(45) Date of Patent: May 31, 2016

(54) DISTRIBUTED TIME SYNCHRONIZATION SYSTEM AND METHOD

(71) Applicant: Apple Inc., Cupertino, CA (US)

(72) Inventors: Nicholas V. King, Cupertino, CA (US); Daniel T. Preston, Cupertino, CA (US); Duncan Kerr, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/279,282

(22) Filed: May 15, 2014

(51) Int. Cl.
*G04G 7/00* (2006.01)
*G04R 20/02* (2013.01)
*G04R 20/00* (2013.01)

(52) U.S. Cl.
CPC *G04G 7/00* (2013.01); *G04R 20/00* (2013.01); *G04R 20/02* (2013.01)

(58) Field of Classification Search
CPC ..... G04G 7/00; G04G 7/02; G04G 7/023; G04G 7/026; G04G 5/00; G04G 5/02; G04C 11/00; G04C 11/02; G04R 20/00; G04R 20/02
See application file for complete search history.

(56) References Cited

U.S. PATENT DOCUMENTS

| | | | | |
|---|---|---|---|---|
| 5,694,537 | A * | 12/1997 | Montenegro et al. | 714/12 |
| 6,236,623 | B1 * | 5/2001 | Read et al. | 368/46 |
| 6,311,283 | B1 * | 10/2001 | Gonzalez | 713/400 |
| 2004/0174895 | A1 * | 9/2004 | Hiraoka | H04B 7/2656 370/442 |
| 2005/0147196 | A1 * | 7/2005 | Quilter et al. | 375/356 |
| 2005/0198240 | A1 * | 9/2005 | Widera et al. | 709/223 |
| 2007/0161385 | A1 * | 7/2007 | Anderson | G01S 19/03 455/502 |
| 2007/0239356 | A1 * | 10/2007 | Woz | G04G 7/026 701/478 |
| 2009/0117928 | A1 * | 5/2009 | Ladd et al. | 455/502 |
| 2010/0091760 | A1 * | 4/2010 | Yoon | 370/350 |
| 2011/0162048 | A1 * | 6/2011 | Bilbrey et al. | 726/4 |
| 2011/0191515 | A1 * | 8/2011 | Luk | G04C 11/02 710/303 |
| 2012/0020191 | A1 * | 1/2012 | Shemesh | G04G 7/02 368/47 |
| 2012/0027030 | A1 * | 2/2012 | Naito et al. | 370/503 |
| 2012/0224540 | A1 * | 9/2012 | Kwon | H04W 76/02 370/329 |
| 2012/0294318 | A1 * | 11/2012 | Fang et al. | 370/503 |

* cited by examiner

*Primary Examiner* — Amy Cohen Johnson
*Assistant Examiner* — Matthew Powell
(74) *Attorney, Agent, or Firm* — Brownstein Hyatt Farber Schreck, LLP

(57) ABSTRACT

A system and method is disclosed for synchronizing device time on various electronic devices. The method and system weigh various factors such as origin of timing signals and elapsed time since last update to determine the most accurate synchronization time.

20 Claims, 8 Drawing Sheets

DISTRIBUTED TIME SYNCHRONIZATION SYSTEM AND METHOD

FIELD

The described embodiments relate generally to portable electronic devices such as laptop computers, phones, and tablets. More particularly, the present embodiments relate to synchronization of timekeeping on portable electronic devices.

BACKGROUND

Time is an important element in the daily lives of most individuals. Many meetings and other events require that the individual arrive in a timely manner Many individuals wear an electronic wristwatch or carry an electronic timepiece in their pocket or purse. Other individuals choose to rely on other portable electronic devices such as laptop computers, portable tablets and portable phones to provide the correct time. Many individuals utilize an electronic calendar in various types of electronic devices to remind them of meetings and events. Reliance on such devices has become an important part of the daily lives of many individuals, both in a business and personal setting.

Many kitchen appliances, test and measurement equipment, such as signal generators, and most portable electronic devices, such as cellphones, clocks, radios, and digital watches, keep time using quartz crystal controlled oscillators. A crystal oscillator is an electronic oscillator circuit that uses the mechanical resonance of a vibrating crystal of piezoelectric material to create an electrical signal with a very precise frequency. Digital logic is used to count the cycles of the signal and to provide a time display in the form of hours, minutes and seconds. The most common type of piezoelectric resonator used is the quartz crystal, so oscillator circuits incorporating them are often referred to as crystal oscillators. Because of their compact size and because they are relatively inexpensive, quartz crystal is generally recognized as the most widely employed system of timekeeping in the world today.

Quartz crystal oscillators are generally accurate to approximately ±15 seconds per month. Environmental factors such as temperature, humidity, pressure and vibration, as well as battery voltage and age of the quartz crystal, typically influence the accuracy of a device's timekeeping. Methods and systems such as thermal compensation have been employed in an attempt to compensate for the environmental factors affecting the accuracy of quartz crystal oscillator timekeeping devices. Other types of materials such as ceramics may be used in some instances to replace quartz but those materials may also have their accuracy affected by various environmental factors.

Several techniques already exist to synchronize devices to a common time base, such as use of the Network Time Protocol (NTP) to synchronize to atomic clocks over the Internet, or use of a Global Positioning System (GPS) receiver to synchronize to the time signal transmitted by each GPS satellite. Typically, these techniques require Internet connectivity or GPS satellite reception, and so will not work under some circumstances. For example, a device that is outdoors may have access to GPS time, while a device that is indoors may only have access to the NTP system.

Because of a desire to have time synchronization among a variety of electronic devices in relative close network proximity it would be desirable to have a method and system which allows for accurate time synchronization among a group of electronic devices under varying conditions.

SUMMARY

Generally, embodiments described herein may facilitate synchronization of time between various electronic devices. The time synchronization may occur between devices connected to one another through a local transmission protocol, such as Bluetooth, an infrared transmission, and/or a radio frequency transmission, through devices connected to one another via a network protocol or local network, and through devices connected to one another through a longer-range protocol, such as the Internet. Time synchronization may likewise occur between devices that are physically connected to one another, for example with a cable or other connector.

Individually, suitable electronic devices may attempt to periodically synchronize themselves to GPS time, as this is generally the most accurate time available. Non-GPS enabled devices may attempt to synchronize time with a NTP or other network-available source. The interval between attempts may be chosen based on the overall desired accuracy. For example, assuming the device time is accurate to ±0.5 seconds per day, then 5 synchronization events per day would be needed to keep the device time accurate to ±0.1 seconds.

With respect to GPS-enabled devices, if GPS time is not available, and a sufficient amount of time has passed since the last synchronization such that NTP time would be considered more accurate than the device time, the device may attempt to synchronize itself to NTP time. The time synchronization method and device time at the time of the last successful synchronization attempt are stored in a computer chip memory on the device. Over time, the average accuracy of device time can be determined from this type of information.

A distributed time synchronization system and method are disclosed to dynamically synchronize a group of electronic devices to a common time base. As a group, electronic devices in proximity to each other can use point-to-point communications through the local network such as Wi-Fi or Bluetooth to "share" or otherwise update device time. The devices can communicate with each other to determine which device in the group has the most accurate time, and synchronize themselves with that device. The most accurate time, or a consensus time, may be determined using a number of factors, such as the elapsed time since the last synchronization, the method of synchronization, and average accuracy of the device.

Among a group of electronic devices in proximity to each other, such as in a room or other designated geographic area, there may be some devices which do not have GPS reception or Internet connectivity to get their device time updated. However, these devices can still communicate with each other using Wi-Fi, Bluetooth, or any other suitable network or local communication protocol. For example, a device near a window may have GPS reception, but a device further inside the meeting room may not. In another example, a device which had been recently carried outside and had its device time updated by a GPS signal may appear on the local Wi-Fi network. In these situations, devices in relatively close proximity may communicate with each other and determine which device in the group has the most accurate time. All electronic devices on that local network will then synchronize their device time to that of the most accurate device time.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
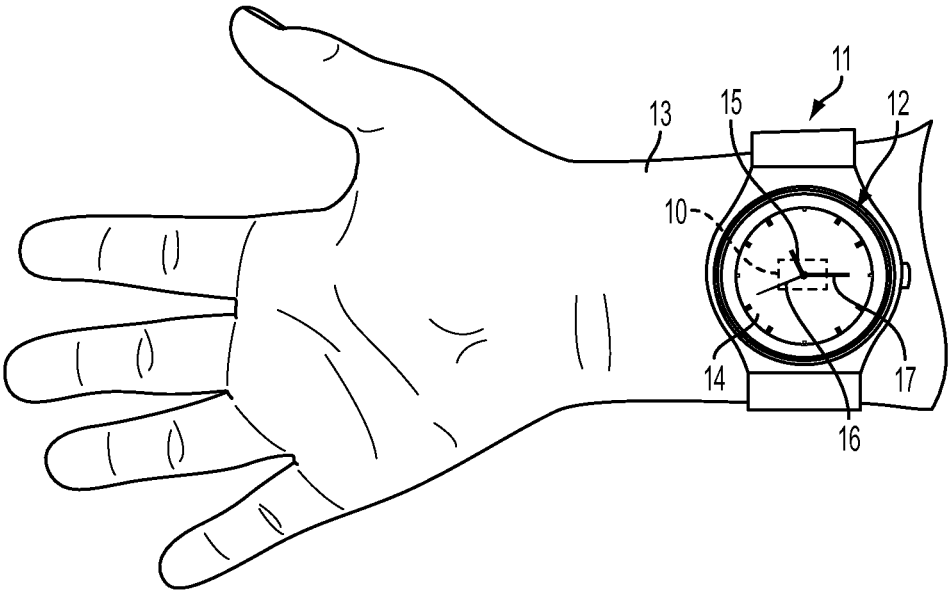
FIG. 1 shows a perspective view of a user wearing an analog display timepiece.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims. Like reference numerals denote like structure throughout each of the various Figures. Various embodiments are discussed below with reference to FIGS. 1-8. However, those skilled in the art will readily appreciate that the detailed description given herein with respect to these Figures is for explanatory purposes only and should not be construed as limiting.

Referring to FIG. 1, a perspective view of an electronic device, which may be an electronic timepiece 11, is worn on the wrist of a user 13. Timepiece 11 includes a display 12 and a computer control device 10 which may control the content of display 12. Display 12 includes a conventional analog clock face 14, which includes an hour hand 15, a minute hand 16 and a second hand 17. User 13 may manually set the correct time by various means as is well known in the timekeeping arts.

Control device 10 may execute instructions and carry out operations associated with portable electronic devices as are described herein. Using instructions from device memory, controller 10 may regulate the reception and manipulation of input and output data between components of the electronic device. Controller 10 may be implemented in a computer chip or chips. Various architectures can be used for controller 10 such as microprocessors, ASIC and so forth. Controller 10 together with an operating system may execute computer code and manipulate data. The operating system may be a well-known system such as iOS, Windows, Unix, or a special purpose operating system or other systems as are known in the art. Control device 10 may include memory capability to store the operating system and data. Control device 10 may also include, or execute, application software to implement various functions associated with the portable electronic device or algorithms to embody a time synchronization system disclosed in various embodiments herein.

Figure 2:
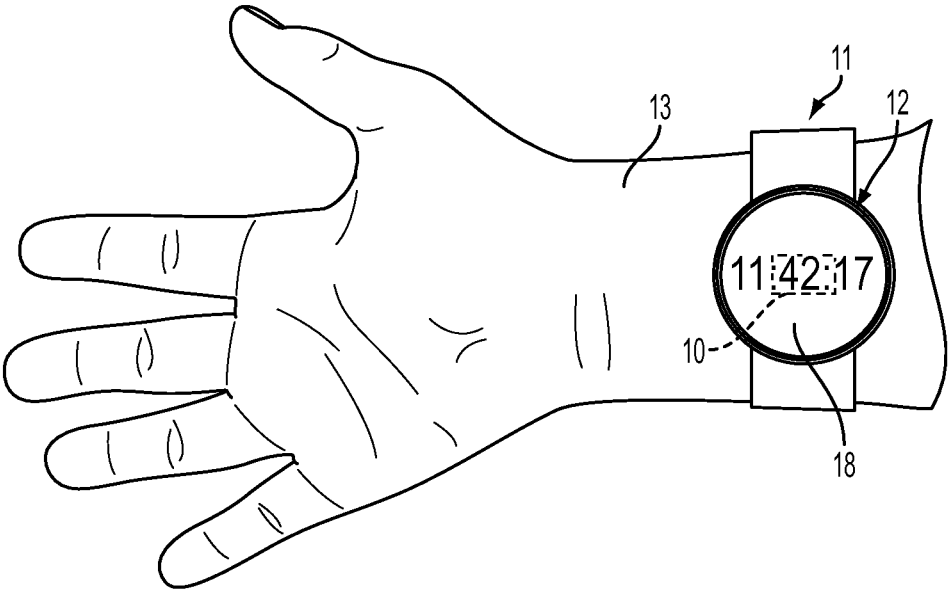
FIG. 2 shows a perspective view of a user wearing an digital display timepiece.

Referring to FIG. 2, user 13 is again depicted wearing an electronic timepiece 11, which in includes display 12. Timepiece 11 includes a computer control device 10, which may be a computer chip that controls the content of display 12. Display 12 includes a clock face 18 with a digital representation of the time as 11:42:17. As with the timepiece 11 shown in FIG. 1, this time may be manually adjusted by user 13 by various means as is well known in the timekeeping arts. That is user 13 may "set his/her watch.2" Generally, the embodiment of FIG. 2 shows an analog clock face as opposed to a digital clock face as shown in FIG. 1. It should be appreciated that the analog clock face may nonetheless be controlled by digital circuitry and/or logic and embodiments described herein may be equally applicable to embodiments shown in FIG. 1 and FIG. 2.

Figure 3:
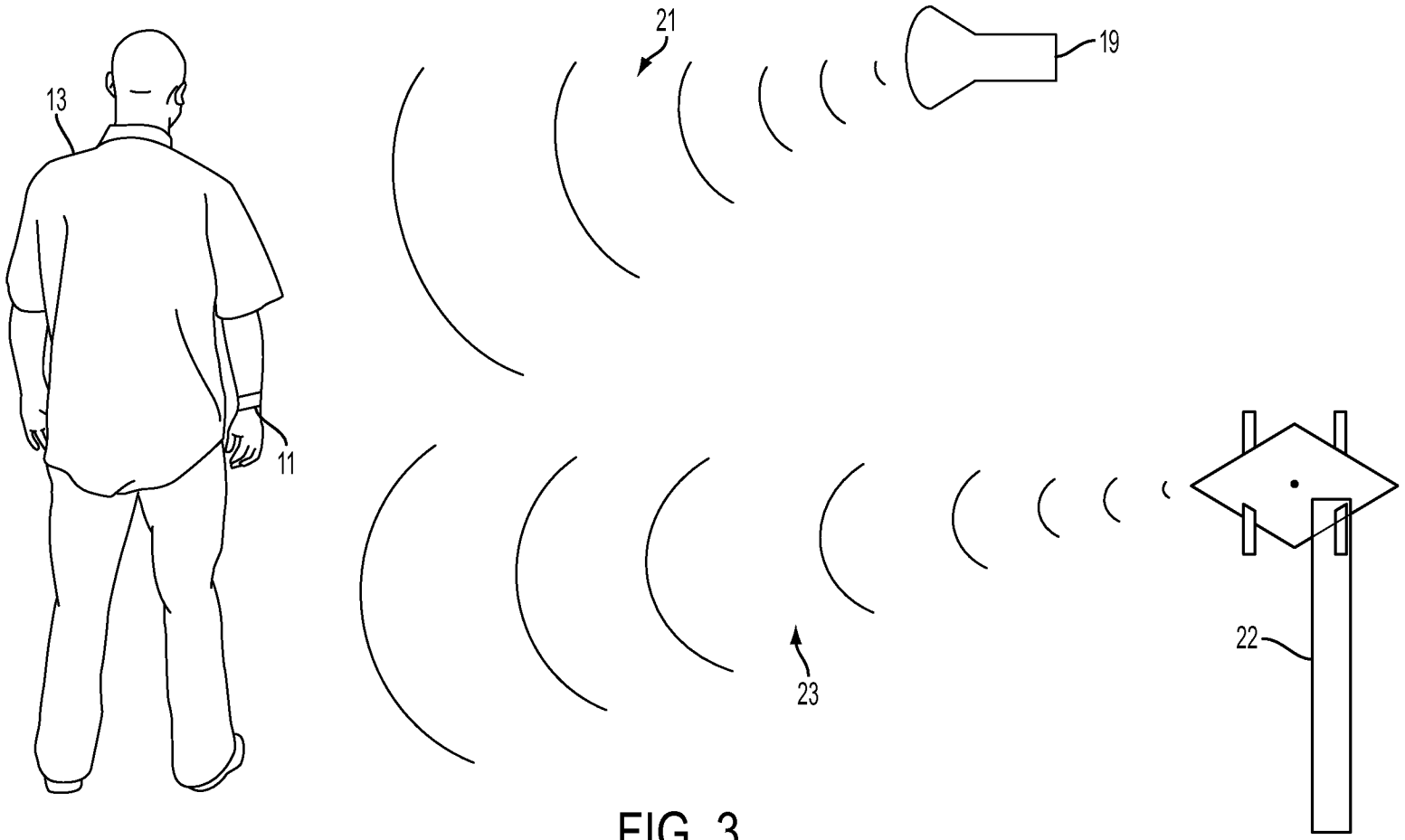
FIG. 3 shows a user electronic device receiving GPS and network signals.

Referring to FIG. 3, user 13 is depicted wearing timepiece 11 in view of, or at least in communication with, a GPS satellite 19. GPS satellite 19 is in orbit above the earth and may transmit a time signal 21, which is received by timepiece 11, and control device 10 updates the time displayed on display 12 based upon time signal 21. That is, when user 13 is in view of satellite 19, the timing signal 21 may be received by timepiece 11. Being in "view" of satellite 19 generally means that the user's device may receive a signal from the GPS satellite or a device relaying such a signal.

When the timepiece 11 cannot receive the GPS signal, the time displayed on timepiece 11 may not be updated by time signal 21 from GPS satellite 19 and any drift of the timing device, which may be a quartz oscillator, may not be corrected. Timepiece 11 may also be in range of cellular tower 22 and receive cellular radio signal 23 that enables communication with other electronic devices through the cellular network.

Figure 4:
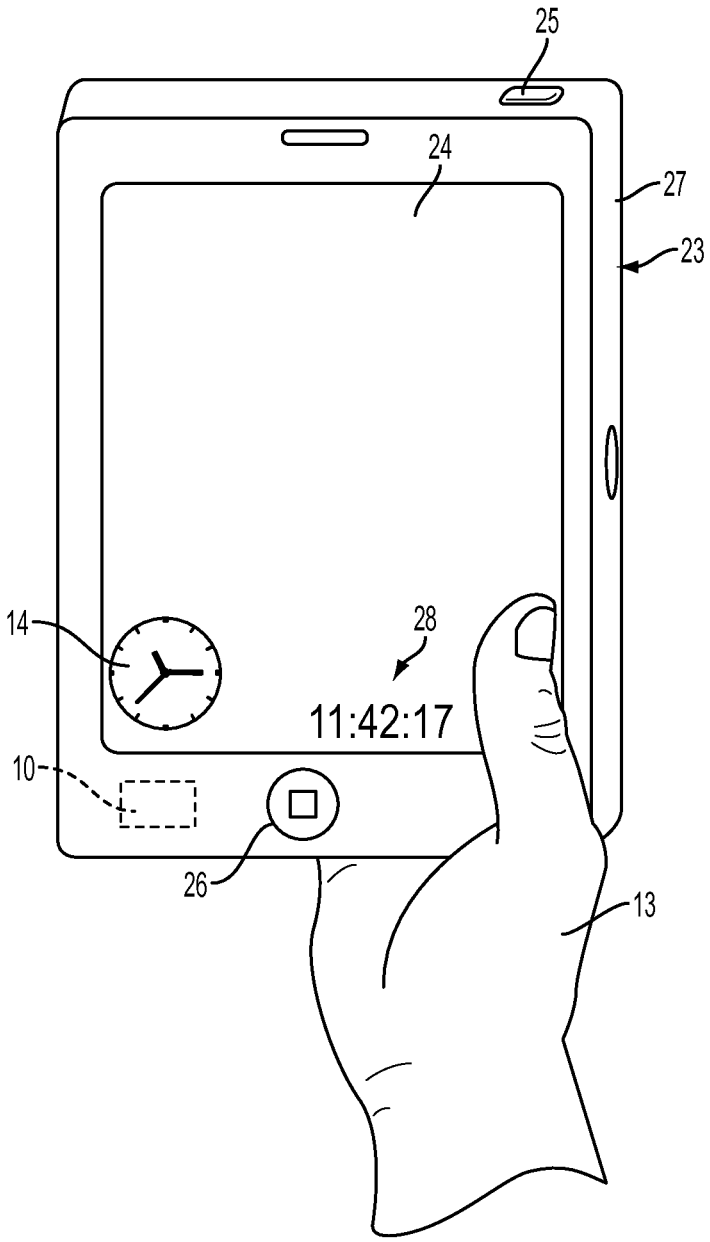
FIG. 4 shows a perspective view of a mobile phone with time display.

Referring to FIG. 4, a perspective view of an electronic device, which may be a mobile phone, such as a smartphone 23, held by user 13. The smartphone 23 includes a display screen 24 which may include a touchscreen. The smartphone 23 may also include additional input controls such as an on/off button 25 and a home button 26 on a housing 27. Smartphone 23 also includes a computer control device 10 which may be a computer chip that controls the content of display screen 24. Display screen 24 may include a time display, which could be an analog display 14 or a digital display 28. Both analog display 14 and digital display 28 are shown in FIG. 4. Displays 14 and/or 28 will show user 13 the device time as then known to smartphone 23. As discussed above, this device time may be updated by various means such as a GPS time signal when smartphone 23 is located in an area with an unobstructed view of the sky such that time signal 21 from GPS satellite 19 may reach it. The smartphone 23 may also receive a Wi-Fi signal 22 through a cellular network or local hotspot as is known in the mobile telephone art.

Figure 5:
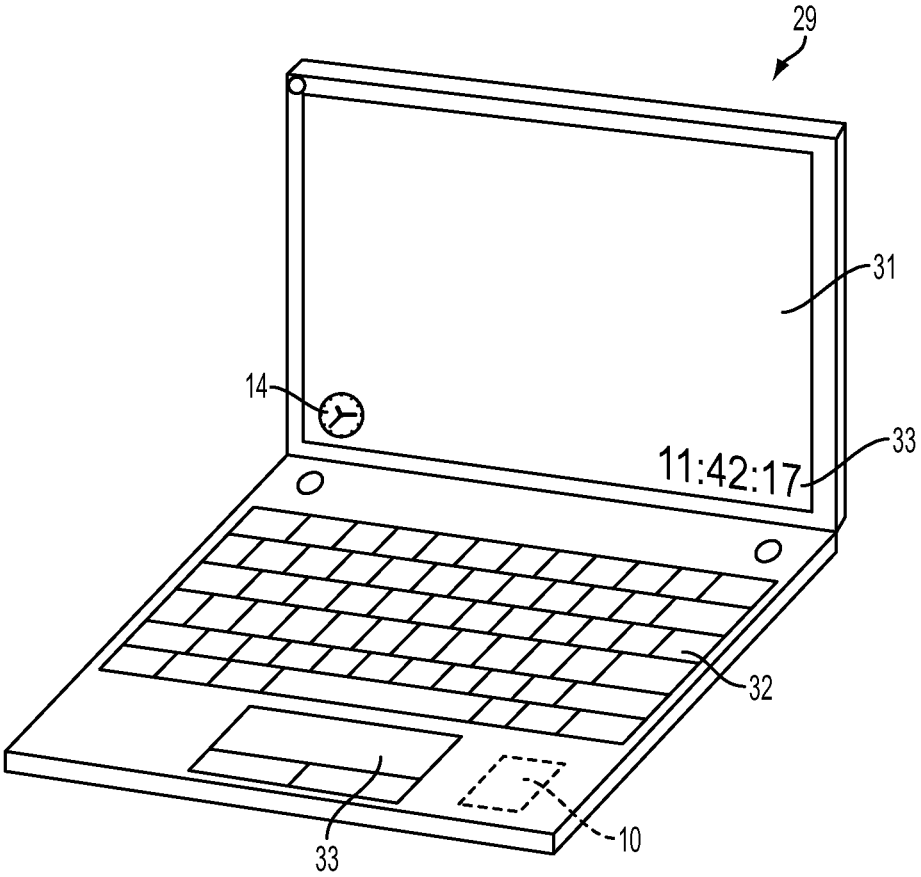
FIG. 5 shows a perspective view of a laptop computer with time display.

Referring to FIG. 5, a perspective view of a laptop computer 29 is shown. Laptop computer 29 includes a display screen 31 and a keyboard 32 as well as user input devices such as mouse and controls 33. Display screen 31 may include a time display, which could be an analog display 14 or a digital display 33 or both. Both analog display 14 and digital display 33 are shown in FIG. 4. Displays 14 and/or 33 will show user 13 the device time as then known to computer 29. As discussed above, this device time may be updated by various means such as a GPS time signal when computer 29 is located in an area with an unobstructed view of the sky such that time signal 21 from GPS satellite 19 may reach it. Computer 29 also includes a computer control device 10 which may be a computer chip that controls the content of display screen 31. Computer 29 may also receive a Wi-Fi signal 22 through a cellular network.

Figure 6:
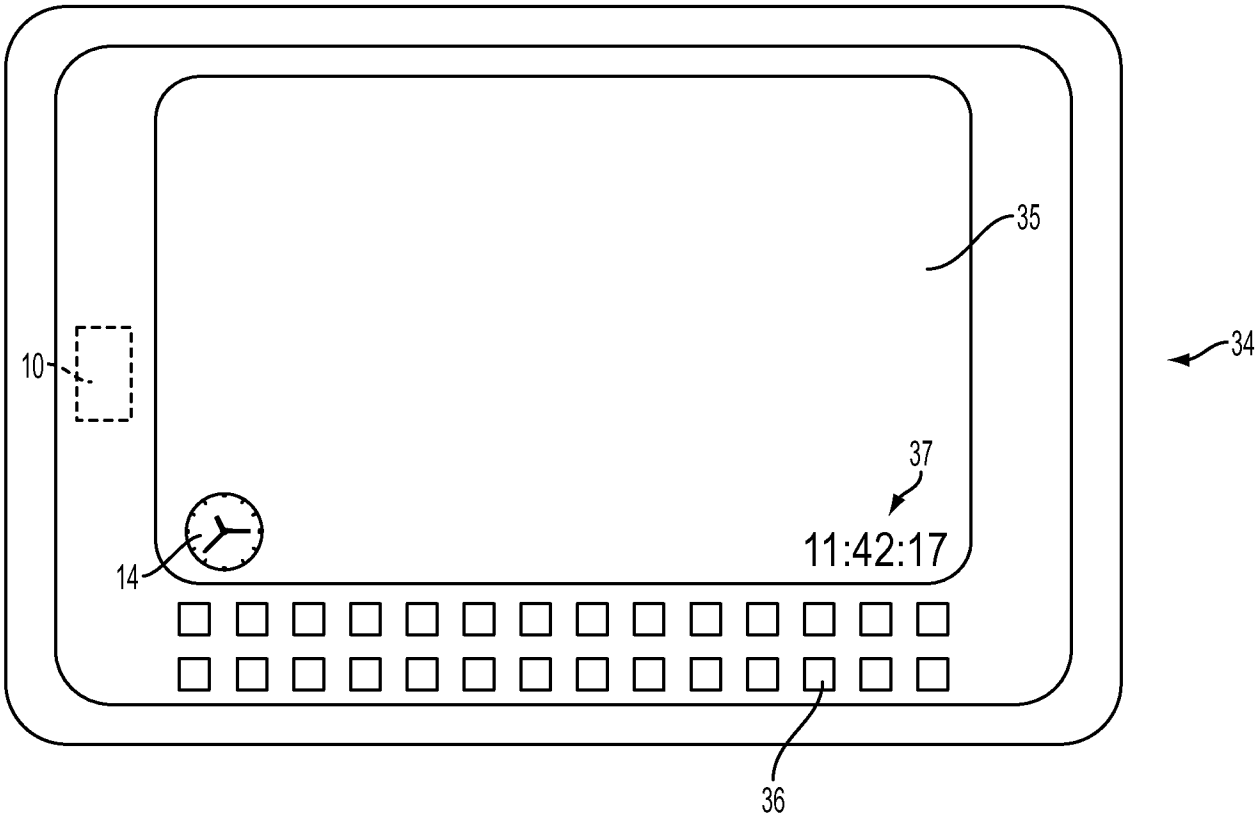
FIG. 6 shows a perspective view of a computer tablet with time display

Referring to FIG. 6, a top view of a mobile computer or tablet 34 is shown. Tablet 34 includes a display screen 35 and user input devices such as a keyboard 36. Display screen 35 may include a time display, which could be an analog display 14 or a digital display 37 or both. Both analog display 14 and digital display 37 are shown in FIG. 6. Displays 14 and/or 37 will show user 13 the device time as then known to tablet 34. As discussed above, this device time may be updated by various means such as a GPS time signal when tablet 34 is located in an area with a communication path 21 from GPS satellite 19. Tablet 34 may also receive a Wi-Fi signal 22 through a cellular network. Tablet 34 also includes a computer control device 10, which may be a computer chip that controls the content of displays 14 and/or 37.

Figure 7:
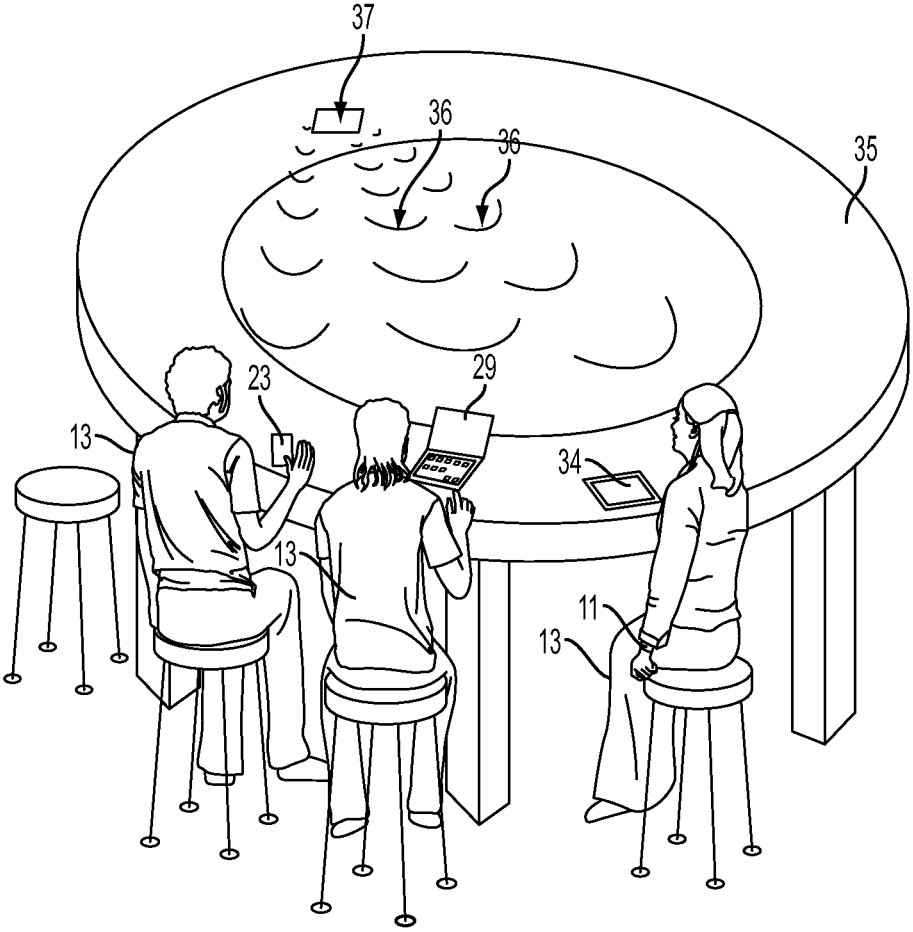
FIG. 7 shows a group of users with electronic devices in a network hotspot.

Referring to FIG. 7, a group of users 13 is shown sitting around a meeting table 35 within a meeting room in a building (not shown). Users 13 may have a variety of electronic devices such as smartphones 23, tablets 34, timepieces 11, and laptop computers 29. Each of these devices may display the time in either analog or digital form as described above. Because users 13 and their associated electronic devices 23, 34, 11 and 29 are located in a meeting room within a building there is no access to timing signal 21 from GPS satellite 19. Thus, the device time for each of electronic devices, 23, 34, 11 and 29 may not have been updated for some period of time and each of these devices may display different times depending upon their accuracy and the amount of time that has elapsed since the device time was last updated. In some situations, one or more users 13 may be sitting near a window and may have access to GPS time signal 21 while others in the room do not have such access and the device time from the device which has received GPS time signal 21 may be used as the synchronization time.

While electronic devices 23, 34, 11 and 29 may not have access to timing signal 21 from GPS satellite 19, they may have access to a Wi-Fi signal 36 from a cellular network thorough a hotspot or other local area network device 37 which may be a router. While network device 37 is shown as located on table 35, it can be appreciated that network device 37 is generally located out of sight in some other portion of the room or building. Some of devices 23, 34, and 29 may also have Internet access through signal 36 and thus may have their device time updated to NTP time. As discussed above, NTP time is not as accurate as GPS time. The variation in device time among electronic devices 23, 34, 11 and 29 may, in some instances, not be significant. However, depending upon the amount of the variation, such differences may be distracting or may result in errors if precise synchronized time among users 13 is required to perform a time sensitive task.

Because GPS time is generally considered to be most accurate, it may be the preferred time to be used to update various devices through a shared communication link. However, if one of devices 23, 34, 11, and 29 has been updated more recently with NTP or other time, the timing of the last update may weigh more heavily in determining the synchronization time. For example, if device 23 has been updated by GPS time three hours prior but device 29 was updated by NTP time five minutes prior, then the time from device 29 may be considered more accurate and be used as the synchronization time.

In one embodiment, the last user 13 entering meeting referred to in FIG. 7 may be considered to be the most accurate because that device time may have been updated most recently. Thus, some embodiments may have devices updated with the time of the last device to enter communication with the others, or may weight this factor when evaluating which time to use as the basis for synchronization. Alternately, it may be determined that all times should be synchronized for convenience or for the orderly progress of a meeting and synchronizing to the last person to enter the meeting room facilitates this purpose. In another embodiment, the system determines which devices are in a predetermined group and time synchronization is permitted only for devices in that group. In another embodiment, the devices in a predetermined group may not be permitted to update time while in a group meeting (within geographic proximity) or for a certain predetermined period of time as during the pendency of a scheduled meeting. In another embodiment, a protocol could be employed in which a device requests a time update at certain time intervals or every device broadcasts its device time at certain time intervals and the scoring system determines the most accurate synchronization time from among those broadcast times.

Referring again to FIG. 7, users 13 may become distracted during a meeting if the device time displayed on laptop computer 29 is noticeably different from that displayed on computer tablet 34. That is, user 13 sitting in front of tablet 34 may notice that the time displayed on laptop computer 29 in front of user 13 sitting next to her differs noticeably from the device time displayed on her tablet 34. The embodiments described herein update each device time within the network such that the device times of each of a plurality of devices in a predetermined area are synchronized. As the meeting concludes and users leave the room to enter other network areas or hotspots, their updated device time may be more accurate and may then update the time on other devices. Thus, the most accurate device time may ripple through a building as users 13 move about the building or from building to building within various local area wireless networks.

While the discussion of electronic devices 11, 23, 34 and 29 has referred to their being updated by time signal 23 from GPS satellite 19, it may be that some or all of these devices may not be able to sense timing signal 23 even if they are located in an area with a clear view of the sky and thus are able to receive signal 23. That is, certain devices are not GPS enabled. As with the situation described above with respect to FIG. 7, it would be desirable to have time synchronization of all electronic devices within a defined area. In one embodiment, by using a local area network hotspot or Wi-Fi network signal such as signal 36, all electronic devices within a predetermined geographic area may have their time display synchronized.

In one embodiment, to determine which of the device times displayed on various electronic devices should be used as the synchronization time, various factors are considered. For example, using the time from an electronic device that has been updated from a GPS time signal 21 may be one sample factor. That is, the origin of the time signal such as whether it is a GPS timing signal, an NTP time signal received via the internet, or even a manually input time change made by a user 13 may be a factor and this information may be utilized in selecting the most accurate device time for synchronization. A second important factor in selecting the most accurate synchronization device time is the amount of time that has elapsed since the device time was last updated. For example, while GPS time may be preferred, if the device time on one electronic device was last updated some number of hours previous by a GPS signal, but another electronic device time was updated by an NTP timing signal two minutes previous, it may be determined that the NTP signal is more accurate.

Another factor in selecting the most accurate device time from among a plurality of electronic devices may be the accuracy of the timing device itself. For example, if a timing device in a GPS enabled electronic device has been updated multiple times in a short time period, then that may be an indication that the quartz oscillator or other timing device may be inaccurate due to age, low battery power or other environmental factors. This inherent inaccuracy may be used as a weighing factor to determine whether the time on that device should be used as the synchronizing time. Similarly, if the device time, when checked against GPS signal time, has remained consistent with the GPS time, then that device time may be favored as the synchronized time. In one embodiment, the number of times that the device time has been updated in a prior predetermined period may be a factor in determining its accuracy for use as a synchronized time. For example, if a device has been updated by one second each week for the last 6 weeks when compared to GPS time, then it can be determined that the device time will be unreliable by some amount and this may be a weighing factor in determining its suitability for use as synchronization time. In another embodiment, if a device has not required a time synchronization because it has maintained its accuracy, it may not be required to check its device time as often as other devices. In addition, this more accurate device may be used as a more reliable indicator of the most accurate synchronization time when a scoring system is used for time synchronization of various devices.

The disclosed embodiments use distributed time synchronization to dynamically synchronize a group of electronic devices to a common time base. As a group, electronic devices in proximity to each other can use point-to-point communications through the local network such as Wi-Fi or Bluetooth to 'share' time. The devices can communicate with each other to determine which device in the group has the most accurate time, and synchronize themselves with that device. The 'most accurate time' may be determined using a number of factors, some of which may be the elapsed time since the last synchronization, the method of synchronization, and average accuracy of the device. The disclosed embodiments may be implemented in the electronic devices by software programming in control device 10. Control device 10 may be programmed to consider weighing the above accuracy factors such as origin of the time signal and amount of elapsed time since the device time was last updated.

Similarly computer chip may be programmed to consider the accuracy of the crystal oscillator or other timing mechanism itself. Various triggers for updating the device time may also be programmed into control device 10. For example, the device time could be updated whenever the device obtains a GPS time signal 21 as this is generally considered to be the most accurate time signal. The device could also be programmed to update periodically if no GPS signal has been obtained within a predetermined time. The device time could also be updated based upon entry into a new local area network or hotspot. The device could be updated based upon detecting a plurality of other devices such as when a user 13 enters a meeting room. The device time could be updated every time user 13 accesses his or her calendar. Some electronic devices may include sensors to detect vibrations or other motion of the device signifying that the user may be running and this activity may trigger time synchronization. Automobiles may be programmed to automatically connect a mobile phone to the car radio system via a Bluetooth connection when the automobile is started and this could trigger time synchronization in an electronic device.

The device could use a calendar as an updating mechanism. In one embodiment, the device time may be updated every morning at a certain time such as when the user awakens. In another embodiment, the device time could be updated at certain other times of the day such as every hour during a workday but less frequently or not at all in the evening. In another embodiment, an updating event could be triggered by the detection of a new network by the device. In another embodiment, devices may update or share time upon waking or receiving a signal (like from an accelerometer) that may correspond to a motion made to check time (raising wrist to look at watch, pulling phone from pocket such as an accelerometer detecting movement from a stationary position to motion across an arc). In another embodiment one device may initially set a device time before it polls others, a for example when a device is turned on or activated and it doesn't have time to receive a time update from other devices it may attempt to update its device time by accessing GPS or other available time standards. In another embodiment, the device may be programmed to synchronize its device time from another device after its screen blanks or it is put down.

Figure 8:
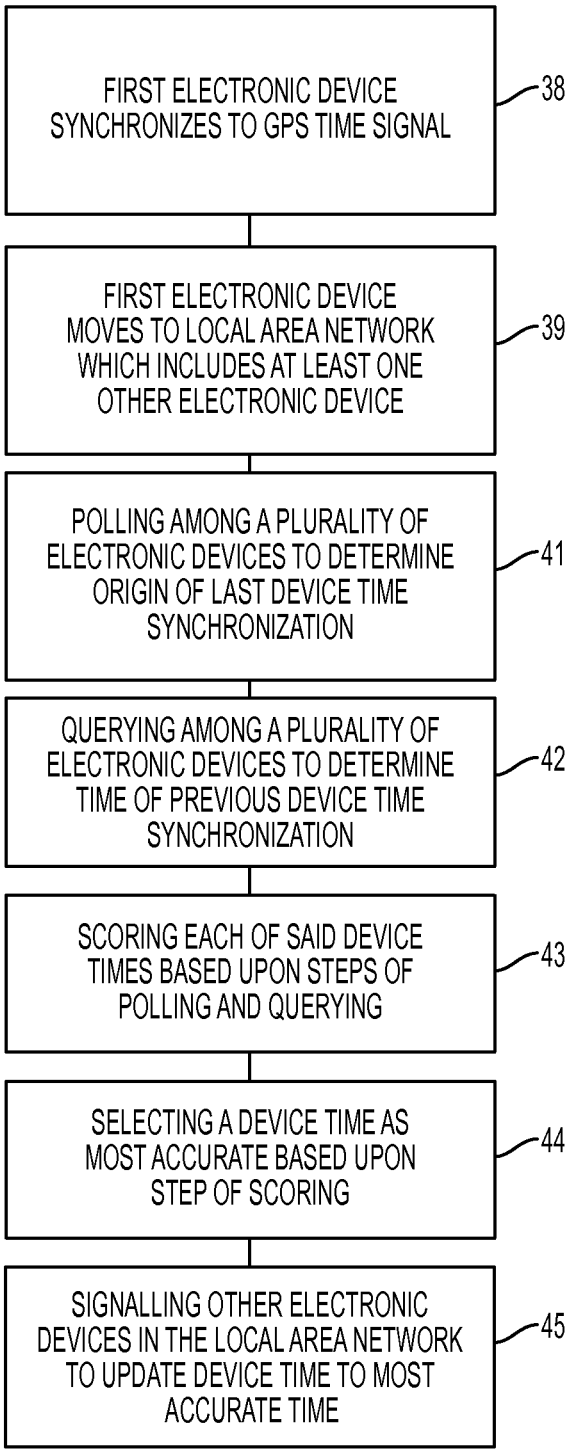
FIG. 8 is a flow chart illustrating operations for time synchronization in one embodiment.

Referring to FIG. 8, a flow chart illustrating one embodiment of a time synchronization method is disclosed. A triggering event prompts the electronic device to update its device time. The triggering event may be movement of the electronic device, entry into a new local area network, the passage of time, detection of adjacent electronic devices within a predetermined distance or other events such as detection of a GPS signal. In operation 38, an electronic device receives a time signal from a GPS satellite. The electronic device has its device time updated. At operation 39 the electronic device is moved to a new local area network and is located within a predetermined proximity to at least one other electronic device.

At operation 41, the control device 10 in electronic devices within the local area network of operation 39 are polled via a local area network to determine the origin of the last time synchronization of each device. At operation 42, the electronic devices in the local area network of operation 39 are queried to determine the timing of the last time synchronization of each device. At operation 43, a device time from one of the electronic devices is scored as the most accurate based upon operations 41 and operation 42. That is, a scoring system may be implemented which includes a determination of the time since the last update of the device clock and what was the origin of that update (GPS, NTP etc.). The score could also factor in the inherent accuracy of the device, which, in one embodiment, could be determined by how frequently the device must be updated (i.e. the number of time updates in a certain time period in order to keep the device synchronized to GPS time). An algorithm programmed into controller 10 may implement the scoring system. At operation 44, this device time is then selected as the most accurate time. At operation 45, the most accurate device time from operation 44 is communicated to each of the other devices within the local area network and those devices update their respective device times to match the selected most accurate time. In an alternate embodiment, the communication of the most accurate time may be made from one device to another directly rather than broadcast to all devices in the area.

In embodiments where the current time of the electronic device is corrected, revised or otherwise changed to a shared or more accurate time, the device may also keep track of the original (e.g., unchanged) time. Some embodiments may revert to the original time after a period passes or an event occurs, such as the end of a scheduled meeting, a user setting the device to the original time or otherwise choosing the original time, reaching a certain destination (which may be detected by a position sensor such as the aforementioned GPS sensor), and so on. Certain embodiments may display both the original time and the shared time simultaneously. Likewise, some embodiments may only update a time upon a user's approval, either explicitly or implicitly (for example, through permitting or enabling such updating as a menu setting).

Further, certain embodiments may use the updates to a more accurate time to estimate a discrepancy between a device's internal time and the more accurate time. This estimation, optionally along with an estimation or measurement of a rate of change between the two, may be used to account for any error, drift or delay in the time measured and outputted by the device. As the device is updated more frequently through acceptance of a shared time, the estimation of both deviation from accurate time and a rate of change of the deviation may become more accurate, thus permitting the device to more accurately compensate for such error. This may permit the device to self-calibrate by leveraging the shared time obtained from more accurate devices or other sources, for example.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. A method for synchronizing device time among a plurality of electronic devices in a local area network comprising the operations of:

prompting one or more of the electronic devices to update a device time in response to a triggering event;

polling each of the electronic devices to determine the origin of the previous device time update of each of the electronic devices;

querying each of the electronic devices to determine the amount of elapsed time since the previous device time update in each of the electronic devices;

scoring the accuracy of the device time of each of the electronic devices based upon the operations of polling and querying;

selecting the most accurate device time based upon the operation of scoring; and updating the device time on each of the electronic devices to the most accurate device time.

2. The method of claim 1 wherein the triggering event includes a user accessing a calendar on one of the plurality of the electronic devices.

3. The method of claim 1 wherein the operation of scoring includes determining the number of times that the device time in each of the electronic devices has been updated in a time period.

4. The method of claim 1 wherein the triggering event includes detecting a plurality of the electronic devices.

5. The method of claim 1 wherein the triggering event includes determining the absence of a GPS signal for a predetermined time.

6. The method of claim 1 wherein the triggering event includes detecting that the electronic device has entered a different local area network.

7. The method of claim 1 wherein the triggering event includes detecting motion of the electronic device.

8. The method of claim 1 wherein the triggering event includes detecting a time of day.

9. The method of claim 1 wherein the triggering event includes detecting an adjacent electronic device within a predetermined distance.

10. The method of claim 1 wherein the triggering event includes detecting a GPS signal.

11. A system for updating device time on a plurality of electronic devices comprising:

a local area network electromagnetically connected to the electronic devices;

a crystal controlled oscillator in each of the plurality of the electronic devices;

a computer control device in each of the plurality of electronic devices;

a time display device in each of the plurality of electronic devices; and wherein said computer control device selects a most accurate device time from among a device time on each of the plurality of electronic devices based upon the origin of and the amount of elapsed time since the last update of the device time on each of the plurality of electronic devices.

12. The system of claim 11 wherein the plurality of electronic devices are located in a room in a building.

13. The system of claim 11 wherein the computer control device in each of the plurality of electronic devices determines the accuracy of the device time in that electronic device based upon the frequency and amount of prior device time updates in that electronic device.

14. The system of claim 11 wherein each of the plurality of electronic devices includes a sensor for detecting a triggering event.

15. The system of claim 14 wherein the sensor includes an accelerometer.

16. A method for synchronizing device time displays on a plurality of electronic devices in a local area network comprising the operations of:

determining an accurate device time from among a plurality of device times in the plurality of electronic devices, the operation of determining including:

polling each of said electronic devices to determine the origin of the last device time update of each of the electronic devices; and querying each of the electronic devices to determine the time of the last device time update of the electronic device.

17. The method of claim 16 further including the operation of updating the device time on each of said electronic devices to the most accurate device time.

18. The method of claim 16 wherein the origin of at least one of the device times is a GPS time signal.

19. The method of claim 16 further including the operation of determining the number of times that the device time in each of the electronic devices has been updated in a time period.

20. The method of claim 16 further including the operation of sensing a triggering event.

* * * * *